United States Patent [19]

Barker

[11] 4,130,457

[45] Dec. 19, 1978

[54] METHOD OF PULPING WITH POLYSULFIDE

[75] Inventor: Richard G. Barker, Princeton Junction, N.J.

[73] Assignee: Union Camp Corporation, Wayne, N.J.

[21] Appl. No.: 533,193

[22] Filed: Dec. 16, 1974

Related U.S. Application Data

[63] Continuation of Ser. No. 366,758, Jun. 4, 1973, abandoned.

[51] Int. Cl.[2] ..... D21C 3/04

[52] U.S. Cl. ..... 162/82; 162/DIG. 2

[58] Field of Search ..... 162/82, 19, DIG. 2, 162/76

[56] References Cited

U.S. PATENT DOCUMENTS

| | | | |
|---|---|---|---|
| 3,551,286 | 12/1970 | Barker | 162/82 |
| 3,567,572 | 3/1971 | Clayton et al. | 162/82 X |
| 3,644,919 | 5/1972 | Clayton et al. | 162/19 |
| 3,661,698 | 5/1972 | Clayton et al. | 162/82 X |

*Primary Examiner*—S. Leon Bashore
*Assistant Examiner*—Steve Alvo
*Attorney, Agent, or Firm*—Kane, Dalsimer, Kane, Sullivan and Kurucz

[57] ABSTRACT

Significant yield increases are obtained in pulping of wood or other lignocellulosic materials with polysulfide liquors through particular control of the times and temperatures of treatment. The lignocellulosic material is treated with a polysulfide liquor at less than 100° C for about 45 minutes, the liquor is removed for reuse, the impregnated lignocellulosic material is quickly steamed to pulping temperature and is pulped at a low temperature of about 160° C for a short period of time.

12 Claims, 1 Drawing Figure

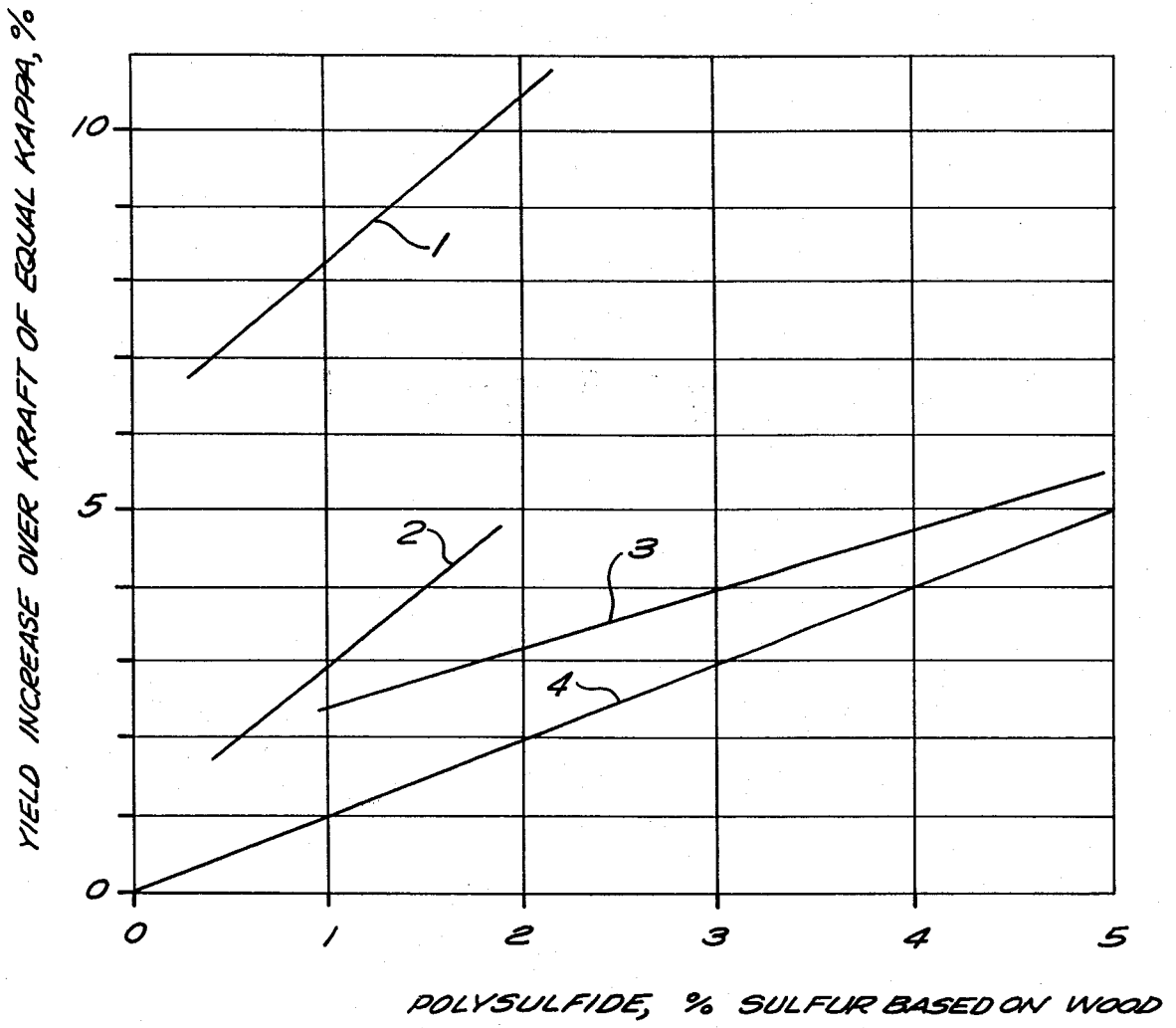
YIELD INCREASE OVER KRAFT OF EQUAL KAPPA, %
10
5
0
0
1
2
3
4
5
POLYSULFIDE, % SULFUR BASED ON WOOD
1
2
3
4

METHOD OF PULPING WITH POLYSULFIDE

This is a continuation of application Ser. No. 366,758, filed June 4, 1973, now abandoned.

CROSS-REFERENCES TO RELATED APPLICATIONS

The process of this application can employ the pulping composition described and claimed in U.S. Pat. No. 3,551,286.

BACKGROUND OF THE INVENTION

The pulping of wood and other lignocellulosic materials with polysulfide liquors is known in the art. For example, U.S. Pat. No. 3,470,061, assigned to the same assignee as the present invention, describes a method for preparing polysulfide liquors by oxidation of the sulfide values with various manganese compounds. Previously referenced U.S. Pat. No. 3,551,286 describes the advantages obtained from pulping with a polysulfide liquor having a particular range of chemical values and claims the composition having that range of values. U.S. Pat. No. 3,653,842, also assigned to the same assignee as the present application, describes a particular process for oxidation and regeneration of the manganese compounds employed according to the proces of U.S. Pat. No. 3,470,061. In addition to these patents, there have been competitive patents describing pulping of wood and lignocellulosic materials with polysulfide liquors.

For example, Clayton et al., U.S. Pat. Nos. 3,664,918 and 3,664,919, describe particular processes for pulping with polysulfide liquors. The U.S. Pat. No. 3,664,918 specifically requires saturation of the wood chips with water before the polysulfide treatment, saturation being defined as from 180 to 200 percent water for soft woods and 150 percent water for hard woods. Following saturation, the chips are impregnated with an alkaline cooking liquor at a temperature below 110° C. for about 60 minutes. The liquor is then removed and the impregnated wood chips are steamed at 170° to 175° C. According to the patent, if the chips are not impregnated with water before the treatment, then significantly lower yields are obtained.

In the Clayton et al. U.S. Pat. No. 3,664,919 impregnation is carried out at a low level, preferably below 6 percent polysulfide on wood. Again, the chips must be saturated with water prior to the treatment and the treatment is then carried out in essentially the same manner as in Clayton U.S. Pat. No. 3,664,918. Clayton U.S. Pat. 3,664,919 requires that the polysulfide be below 50 grams per liter and that the liquor-to-wood ratio, at the time of alkaline impregnation, be between 2.5:1 and 4:1.

Clayton U.S. Pat. No. 3,567,572 involves a multistep process which again requires an initial step of water saturation of chips before treatment. The saturated wood is then treated with polysulfide in the absence of an alkali, followed by treatment with alkali. A steaming is then carried out which may be in the presence of ammonia or hydrogen sulfide.

Other prior art patents dealing with polysulfide pulping of wood include U.S. Pat. No. 3,210,235—Ferrigan, Jr. et al; and U.S. Pat. No. 2,944,928—Kibrick et al. The Ferrigan, Jr. patent involves addition of elemental sulfur to white liquor in order to create a polysulfide pulping liquor, while Kibrick et al show heating in a pressure vessel for approximately 4 hours in order to accomplish digestion.

SUMMARY OF THE INVENTION

In accordance with the present invention, an improved process for pulping of wood and other lignocellulosic materials with polysulfide pulping liquors is described. In accordance with this process, significantly increased yields of pulp are obtained, with lower chemical treatments applied to the wood than with other prior art processes. As lower chemical amounts are applied to the wood for these improved yields, the process is more economic and the lower sulfur losses result in significantly lowered levels of pollution.

Specifically, the present process involves the following steps:

1. Impregnation of the wood or other lignocellulosic materials is advantageously carried out with a polysulfide pulping liquor having from 5 to 60 grams per liter of sulfur, where from 43 to 80 percent of the sulfur is alkali metal polysulfide, from 40 to 15 percent is alkali metal sulfide, and up to 17 percent is alkali metal thiosulfate. While the listed composition is preferred, polysulfide pulping liquors with other compositions can also be employed. This impregnation is carried out at a temperature of less than 100° C. for a short period of time, approximately 45 minutes. 2. All excess liquors is removed from the chips being impregnated and can then be reused, after fortification to the initial polysulfide levels. 3. The impregnated chips are directly steamed in order to heat them to pulping temperature rapidly. 4. Pulping is carried out at relatively low temperatures, for example, from about 140° to 165° C.

By following this series of steps, significantly increased yields of pulp are obtained with relatively low applications of pulping material chemicals when compared, particularly, with kraft processes and with other polysulfide processes.

While pulping rates are normally speeded up and yields accordingly decreased at higher temperatures, it has been found that with the combination of steps disclosed, higher yields can be obtained at equivalent Kappa numbers in essentially normal pulping times.

Another important part of the present process is the level of application of pulping liquor to the wood or other lignocellulosic material to be pulped. It has been found that the application level should be at least 4.5:1 at this provides for complete coverage of the chips, particularly when using slash pine. When the ratio of pulping liquor to wood chips is greater than 4.5:1, the process becomes less economic as additional liquor is employed, because the additional liquor cannot be effectively used. It is important, only, with respect to liquor level, that the chips be completely covered with the pulping liquor and thus it should be used in a ratio of at least 4.5:1.

DESCRIPTION OF THE DRAWING

The accompanying drawing illustrates the increases in pulp yield, based upon polysulfide application level, for the process of the present invention and several prior art processes.

DESCRIPTION OF THE PREFERRED EMBODIMENTS

In accordance with the present invention, wood, or other lignocellulosic material to be pulped, is impregnated with a pulping liquor containing polysulfide ions. The materials employed in the impregnation can be that described in my prior U.S. Pat. No. 3,551,286, issued Dec. 29, 1970. As described in that patent, the polysulfide pulping liquor contains from 5 to 60 grams per liter of sulfur. Not only is the amount of sulfur important, but the ratios of different types of sulfur in the pulping liquor are even more important. Particularly, from 43 to 80 percent of the sulfur should be in the form of an alkali metal polysulfide, from 40 to 15 percent of the sulfur should be in the form of an alkali metal sulfide, and less than 17 percent of the sulfur should be in the form of an alkali metal thiosulfate. Preferably, for economic reasons, the alkali metal is sodium. Other polysulfide liquors can also be employed according to the process of the present invention.

An important factor in carrying out the process of the present invention is the ratio of liquor to wood in the impregnation step. The amount of liquor present should be sufficient to completely cover the chips which are to be pulped. Thus, the ratio should be at least 4.5:1, by weight, and this is this optimum amount. Greater ratios of liquor to wood can be employed, but the amount which has been found to effectively work is that which covers the wood chips. Accordingly, 4.5:1, which is the necessary ratio, particularly for slash pine, is the optimum ratio.

The time of the impregnation with the pulping liquor should vary from about 30 to 120 minutes. Forty-five minutes has been found to be the optimum time of treatment. The temperature of the impregnation is important and can vary from about 60° to 100° C. Preferably, the temperature is from about 60° to 80° C. The white liquor, which is employed in processing, normally is at a temperature of 80° C. as it leaves the processing equipment where it is formed.

Following the impregnation, the pulping liquor and wood chips are separated. The pulping liquor is returned to its original concentration employing a high concentration material, which is separately prepared, and can be reused in impregnating additional lignocellulosic material. When it is desired to determine the exact amounts of pulping chemicals which have been absorbed by the wood in the impregnation step, this can be accomplished by measuring the concentration of the pulping liquor leaving the impregnator and comparing it with the concentration of pulping liquor entering the impregnator.

Following impregnation of the wood chips, or other lignocellulosic material, the impregnated chips are steamed to rapidly raise their temperature to the pulping temperature. The type of steam, e.g., saturated, supersaturated, etc., is not important. It is only important that the steam be employed at a high enough temperature to allow the chips to attain the temperature at which they will be pulped quickly. Frequently, industrial plants have 150 pound steam available and this can adequately be employed. The steaming step should be carried out as quickly as possible, preferably in less than ten minutes. If the time to raise the temperature of the chips to pulping temperature is unduly drawn out, some of the polysulfide will decompose, and the entire yield increase will not be realized. The temperature to which the impregnated chips should be heated in this steaming step is between 140° and 165° C., preferably from 155° to 160° C.

The pulping of the impregnated and steamed chips is now carried out at about 160° C. The amount of time spent in pulping is dependent upon the Kappa number which is ultimately desired and the lower Kappa number desired, the longer the pulping time which is necessary. For example, a Kappa number of from about 80 to 100 is usually desired for liner board, a Kappa number of from about 50 to 60 for ordinary paper, and a Kappa number of about 35 for a bleachable grade pulp. Normal pulping times are from about 1 to 3 hours.

As indicated, the higher yields obtained according to the present process are obtained with a lower utilization of pulping chemicals than in prior processes. In particular, less polysulfide sulfur is used than in prior polysulfide pulping processes. The amount of polysulfide sulfur employed should range from about 0.4 percent to 2 percent, based on wood, and this is accomplished through the conditions of the process as previously described.

No special treatment of the chips is necessary. They can be used in their normal state which is at a moisture content of about 100 percent. Higher and lower moisture contents can also be employed, without affecting the benefits gained according to the present process.

In order that those skilled in the art may be better enabled to practice the process of the present invention, the following examples are given. All parts in these examples are by weight, unless otherwise indicated.

EXAMPLE 1

A kraft white liquor having a sulfidity of 15 percent was oxidized with manganese dioxide to give a polysulfide liquor having a polysulfide content of 75 percent, a sulfide content of 20 percent, and a thiosulfate content of five percent, based on total sulfur. The initial concentrations in this pulping liquor were 68 grams per liter of active alkali (as $Na_2O$) and 3.3 grams per liter of polysulfide sulfur.

The thus formed pulping liquor was applied to slash pine chips having a moisture content of 100 percent. The liquor-to-wood ratio was 4.5:1. This application level corresponded to an initial application of 30.6 percent effective alkali and 1.5 percent polysulfide sulfur.

The chips were treated with the liquor for 45 minutes at a temperature of 70° C. The excess liquor was then removed and left a liquid-to-wood ratio of 1.8:1. The actual chemical consumption in the impregnation process was 14.8 percent effective alkali and 0.4 percent polysulfide sulfur.

The impregnated chips were then steamed to heat the charge to a temperatur of 160° C. in 5 minutes. The impregnated chip charge was maintained at 160° C. for 90 minutes and the pulp yield was then found to be 61.7 percent at a Kappa number of 81. Employing a standard kraft process to form pulp with the same Kappa number, the yield was 54.7 percent.

EXAMPLE 2

A kraft white liquor with a sulfidity of 60 percent was oxidized with manganese dioxide to give a polysulfide liquor having 47 percent polysulfide, 40 percent sulfide, and 13 percent thiosulfate. The initial concentrations in this pulping liquor were 45.3 grams per liter effective alkali ($Na_2O$) and 9.2 grams per liter of polysulfide sulfur.

The pulping liquor was applied to slash pine chips having a moisture content of 100 percent with a liquor-to-wood ratio of 4.5:1. This corresponds to an application level during impregnation of 20.4 percent effective alkali and 4.1 percent polysulfide sulfur. The charge was heated for 45 minutes at 70° C. and the excess liquor was then withdrawn leaving a liquid-to-wood ratio of 1.8:1. The consumption of pulping chemicals was found to be 10.2 percent effective alkali and 1.8 percent polysulfide sulfur.

The impregnated chip charge was directly steamed in 8 minutes to 160° C. and was held at that temperature for an additional 90 minutes. After the pulping process, a pulp yield of 63.6 percent at a Kappa number of 79.7 was obtained. Pulping of slash pine chips from the same batch by a standard kraft process showed a yield, at the same Kappa number, of only 54.3 percent.

In accordance with the method of Ferrigan described in U.S. Pat. No. 3,210,235, a quantity of 3.5 percent sulfur was added to kraft liquor at the beginning of a cook. The liquor was then added to wood and the charge heated to a pulping temperature of 172° C. over a 3-hour period. This was then held at that pulping temperature for 1.5 hours. The 3.5 percent polysulfide sulfur gave a yield increase of 4.3 percent over a standard kraft process. Thus, the yield increases was essentially equivalent, on a percentage basis, to the polysulfide sulfur added, contrary to the results shown above in Examples 1 and 2, according to the process of the present invention.

According to the teachings of Clayton U.S. Pat. No. 3,567,572, the lignocellulosic material was impregnated with polysulfide liquor containing no added sodium hydroxide at a pH of 12.5. The temperature is below the decomposition temperature of polysulfide. The excess polysulfide liquor is then removed, the temperature increased, and the pH adjusted through addition of a sodium hydroxide cocking liquor. The impregnation was carried out at 80° to 90° C., the cooking with sodium hydroxide at 130° C., and the pulping at 170° to 185° C. According to this process, a yield increase of 3.9 percent compared with kraft was obtained using 4.74 percent polysulfide sulfur. Again, at best, the yield increase is equivalent to the polysulfide sulfur added, contrary to the present process.

In a further Clayton patent, Canadian Pat. No. 873,779, a vapor phase polysulfide pulping process is described where the liquor-to-wood ratio in the impregnation process is approximately 4:1. Yield increases shown by Clayton, when compared with kraft processes, are about 2 percent with a 0.6 percent polysulfide addition, 3.2 percent at a 1.1 percent polysulfide addition, and 4.5 percent at a 1.8 percent polysulfide addition. Again, it can be seen that the yield increases are far less than those obtained according to the process of the present invention when compared at equivalent polysulfide levels. For example, the 0.6 percent polysulfide which obtained a 2 percent yield according to this Clayton process can be compared with Example 1 of the present invention where the 7 percent yield increase was obtained at a 0.4 percent polysulfide level.

A comparison of the yield increase as obtained according to the process of the present invention and those obtained according to prior art processes is shown in the accompanying figure. Employing the process of the present invention, the results of which are plotted on line 1, with polysulfide application levels of from about 0.4 percent to about 2 percent, yield increases of 6.5 to 11 percent, when compared with kraft processes, are obtained. With the process of Canadian Pat. No. 873,779, the results of which are plotted on line 2, similar polysulfide application levels result in yield increases of only 1.5 to about 5 percent. The comparison with the processes of U.S. Pat. Nos. 3,470,061 and 2,944,928 are even more striking. The results of processing according to U.S. Pat. No. 3,470,061 are shown in line 3 and illustrate that yield increases of from 2 to about 5 percent are obtained with polysulfide application levels of from about 1 to 5 percent, while yield increases according to U.S. Pat. No. 2,944,928 range up to about 4 percent, with polysulfide application levels of up to 5 percent. Thus, the superiority of the process of the present invention is clearly illustrated.

In accordance with the present invention, a process has been described for more economically pulping wood and other lignocellulosic materials with a polysulfide pulping liquor. Improved yields are obtained with lower pulping chemical application levels. This is accomplished through particular control of processing steps. The invention should not be considered as limited to the specific examples, but only as limited by the appended claims.

I claim:

1. A process for pulping lignocellulosic materials which comprises;

(a) impregnating said materials with a polysulfide pulping liquor having from 5 to 60 gms. per liter of sulfur where from 43 to 80 percent of the sulfur is present as alkali metal polysulfide, from 15 to 40 percent is present as alkali metal sulfide and less than 17 percent is present as alkali metal thiosulfate; said impregnation being carried out at a temperature of from about 60° C. to about 100° C. for a period of from about 30 to about 120 minutes and the ratio of pulping liquor to lignocellulosic material being at least 4.5:1.0 by weight;

(b) separating the impregnated materials from unabsorbed pulping liquor;

(c) steaming the separated materials to a temperature of between 140° C. and 165° C. in a period of less than 10 minutes; and (d) maintaining the steamed and separated from unabsorbed pulping liqor materials at a temperature of from 140° C. to 165° C. until said materials are pulped.

2. The process of claim 1 wherein the impregnating step (a) is carried out at a temperature of from about 60° C. to about 80° C.

3. The process of claim 1 wherein the impregnating step (a) is carried out for a period of about 45 minutes.

4. The process of claim 1 wherein said impregnating step (a) is carried out at a temperature of about 70° C. for a period of about 45 minutes.

5. The process of claim 1 wherein said lignocellulosic material is pine.

6. The process of claim 1 wherein said steaming (c) is to a temperature of from 155° C. to 160° C.

7. The process of claim 1 wherein said steaming (c) is to a temperature of 160° C. in 8 minutes.

8. The process of claim 1 wherein said steaming (c) is to a temperature of 160° C. in 5 minutes.

9. The process of claim 1 wherein said pulping step (d) is at a temperature of from 155° C. to 160° C.

10. The process of claim 1 wherein said pulping step (d) is at a temperature of 160° C.

11. The process of claim 10 wherein said pulping step (d) is carried out for 90 minutes.

12. A process for pulping pine chips which comprises;

(a) impregnating said pine chips with a polysulfide pulping liquor having from 5 to 60 gms per liter of sulfur where from 47 to 75 percent of the sulfur is present as alkali metal polysulfide, from 20 to 40 percent as alkali metal sulfide and from 5 to 13 percent is present as alkali metal thiosulfate; said impregnation being carried out at a temperature of 70° C. for about 45 minutes and the ratio of pulping liquor to pine chips is at least 4.5:1.0 by weight;

(b) separating the impregnated pine chips from unabsorbed pulping liquor;

(c) steaming the separated chips to a temperature of about 160° C. in a period of from about 5 to about 8 minutes; and (d) maintaining the steamed chips separated from unabsorbed pulping liquor at a temperature of about 160° C. until said chips are pulped.

* * * * *